US005854542A

United States Patent [19]

Forbes

[11] Patent Number: 5,854,542

[45] Date of Patent: Dec. 29, 1998

[54] FLASHING AND DIMING FLUORESCENT LAMPS FOR A GAMING DEVICE

[75] Inventor: Mark G. Forbes, Corvallis, Oreg.

[73] Assignee: Acres Gaming Incorporated, Corvallis, Oreg.

[21] Appl. No.: 706,038

[22] Filed: Aug. 30, 1996

[51] Int. Cl.[6] ..... G05F 1/00

[52] U.S. Cl. ..... 315/291; 315/207; 315/209 SC; 315/101; 315/DIG. 5; 362/183; 362/184

[58] Field of Search ..... 315/291, 239, 315/207, 101, 105, 205, 206, DIG. 2, DIG. 5, 56, 58, 209 SC; 362/183, 184, 228

[56] References Cited

U.S. PATENT DOCUMENTS

| | | | |
|---|---|---|---|
| 3,932,801 | 1/1976 | Peters, Jr. | 321/45 C |
| 3,996,493 | 12/1976 | Davenport et al. | 315/58 |
| 4,381,476 | 4/1983 | Adachi et al. | 315/101 |
| 4,399,390 | 8/1983 | Oshita et al. | 315/101 |
| 4,538,092 | 8/1985 | Goralnik | 315/58 |
| 5,111,115 | 5/1992 | Ball et al. | 315/239 |

OTHER PUBLICATIONS

Hammer, E.E. Winter 1995, Cathode Fall Voltage Relationship with Fluorescent Lamps. (Presented at the 1994 IESNA Annual Conference). *Journal of the Illuminating Engineering Society*, pp. 116–121.

Leyh, T.O., Winter 1995, Design Considerations for New Highly Loaded High–Frequency Fluorescent Lamp Systems. (Presented at the 1994 IESNA Annual Conference). *Journal of the Illuminating Engineering Society*, pp. 63–68.

Gyoten, M., Ito, K., and Yoshikawa, N., Summer 1995, Development of an Electronic Starter for Fluorescent Lamps. (Presented at the 1994 IESNA Annual Conference). *Journal of the Illuminating Engineering Society*, pp. 86–90.

*Primary Examiner*—Don Wong

*Assistant Examiner*—Haissa Philogene

*Attorney, Agent, or Firm*—Marger Johnson & McCollom, P.C.

[57] ABSTRACT

A method and apparatus for signaling promotional operation of a gaming device using existing fluorescent illumination lamps. An illumination lamp on a gaming device is operated continuously during normal operation, then flashed to signal promotional operation. Alternatively, an illumination lamp can be dimmed during normal operation, then operated at full brightness during promotional operation. To achieve flashing and dimming operation, a conventional starter is removed from a socket in a fluorescent lamp fixture and replaced with a controllable starter that fits into the same socket. The starter has a pair of wire leads for receiving a control signal for flashing or dimming the lamp. The controllable starter includes a starter circuit having a switch connected between two power terminals of the starter. When the switch closes responsive to the control signal, it shorts circuits the lamp, thereby extinguishing the arc and allowing preheat current to flow in the heating filaments of the lamp. When the switch opens responsive to the control signal, an arc is struck. By repetitively opening and closing the starter switch, the lamp is made to flash. The lamp is dimmed by flashing the lamp a high enough frequency that the lamp appears to operate continuously. The brightness of the dimmed lamp is controlled by adjusting the duty cycle of the switch. Flashing and dimming operation is combined with multiple colored fluorescent lamps to signal promotional operation.

41 Claims, 4 Drawing Sheets

FLASHING AND DIMING FLUORESCENT LAMPS FOR A GAMING DEVICE

BACKGROUND OF THE INVENTION

1. Field of the Invention

This invention relates generally to starter circuits for fluorescent lamps and more particularly to a method and apparatus for starting, flashing and dimming fluorescent lamps to provide signaling features for gaming devices.

2. Description of the Related Art

Gaming devices such as slot machines typically utilize fluorescent lamp fixtures to illuminate decorative glass panels. Referring to FIG. 1, a conventional slot machine is shown generally at 10. The slot machine 10 includes a twin-bulb fluorescent light fixture 12 having two fluorescent bulbs 14 and 16. Another fixture 18 has a single fluorescent bulb 20. Fixtures 12 and 18 are only used for passive illumination of decorative glass such as panel 32.

As new gaming techniques have been developed, special bonus controllers have been added to new and existing gaming devices, and additional light fixtures have been added to signal special promotional events such as enhanced bonuses. Referring again to FIG. 1, a dedicated light fixture 22 mounted on the top of the slot machine is used to signal special events by illuminating light segments 24, 26, 28, and 30.

A problem with this type of dedicated light fixture is that it adds cost and complexity to the machine when it is manufactured. Further, many gaming devices have been, and continue to be, manufactured for conventional operation only, and thus, only have fluorescent illumination fixtures. In order to support special promotional operation, the machines must be upgraded with additional signaling light fixtures. However, retrofitting existing gaming devices with special signaling light fixtures is expensive and time consuming.

Accordingly, a need remains for a less expensive technique for signaling promotional operation of gaming devices.

SUMMARY OF THE INVENTION

It is, therefore, an object of the invention to provide an inexpensive technique for signaling promotional operation of gaming devices.

Another object of the invention is to provide flashing and dimming operation for fluorescent lamps without requiring expensive circuitry.

A further object of the invention is to reduce the time and expense required to modify fluorescent illumination lamps for flashing and dimming operation.

To accomplish these objectives, the applicant has invented a method and apparatus for utilizing existing fluorescent illumination lamps to signal promotional operation of a gaming device. In one embodiment, a fluorescent lamp fixture in a gaming device is operated continuously during normal play, then operated in a flashing mode to signal promotional operation of the device. In another embodiment, the lamp is operated at a reduced intensity during normal play, then operated at full brightness during a promotional event.

To implement these signaling techniques, a conventional starter is removed from a fluorescent lamp fixture in a gaming device, and replaced with a controllable starter that fits into the same socket as a conventional starter. The starter includes a control port that is coupled to a bonusing controller in the gaming device which generates a control signal that causes the controllable starter to flash or dim the fluorescent lamp to signal a promotional operation. An advantage of this technique is that it minimizes the incremental cost of retrofitting an existing gaming machine with bonusing hardware because it utilizes the existing lamp fixture.

In another aspect of the invention, flashing and dimming operation is combined with multiple colored fluorescent lamps to signal promotional operation. This has the further advantage of adding visual interest and impact to the gaming device.

A further aspect of the present invention is a controllable starter circuit which replaces a conventional starter in a fluorescent lamp fixture. The circuit includes a switch that provides a controlled current path between the two power terminals of the starter. A control port on the starter receives a control signal for opening and closing the switch, thus causing lamp to turn on and off.

A further aspect of the present invention is a method for flashing a fluorescent lamp by repetitively opening and closing a starter switch, thereby turning the lamp on and off. During the off portion of the cycle, the closed switch causes preheat current to flow through the filaments, thereby providing for easy restriking of the lamp when the switch is opened.

A further aspect of the present invention is a method for dimming a fluorescent lamp by repetitively opening and closing a starter switch and turning the lamp on and off at a high enough frequency that the lamp appears to be glowing continuously. The dimming level is controlled by adjusting the duty cycle at which the switch is opened and closed.

The foregoing and other objects, features and advantages of the invention will become more readily apparent from the following detailed description of a preferred embodiment of the invention which proceeds with reference to the accompanying drawings.

DETAILED DESCRIPTION

Monochrome Signaling

Figure 1:
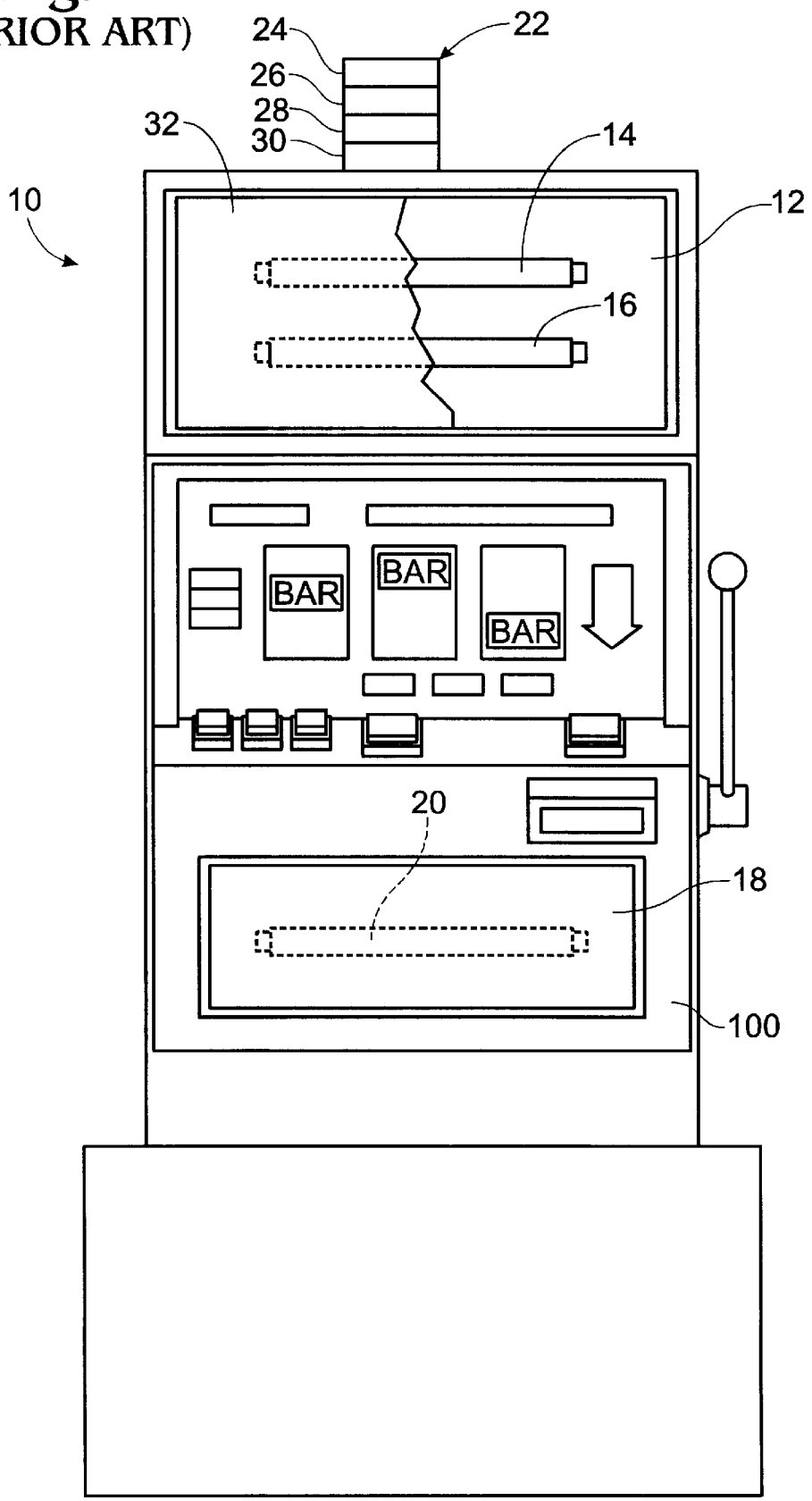
Fig. 1 (PRIOR ART)
FIG. 1 is an elevational view of a prior art slot machine.

A gaming device operated according to the present invention operates one or more existing fluorescent illumination lamps in a flashing mode or a dimming mode to signal promotional operation of the device. One method according to the present invention is to operate a fluorescent illumination lamp on a gaming device in a continuous mode during normal operation, then operate the lamp in a flashing mode to indicate a special jackpot or promotion associated with the particular gaming device.

To implement this method, an embodiment of a gaming device according to the present invention includes a fluorescent lamp fixture having a conventional magnetic ballast and neon starter. A switch is used to interrupt the flow of power to the lamp circuit, thereby causing it to flash. The switch can be controlled by a controller which can be integrated with the bonusing hardware in the gaming device. An advantage of this embodiment is that it adds little cost because it uses the existing fluorescent light circuitry. Only a switch need be added. This also makes it easy to retrofit existing gaming devices when bonusing hardware is added. Although the maximum flashing rate is limited because of the preheat requirements for a conventional fluorescent lamp circuit, as will be explained more fully below, this embodiment still provides signaling functions at a low cost.

Another method according to the present invention is to operate a fluorescent illumination lamp on a gaming device in a reduced brightness mode for normal operation, then raise the lamp output to a full brightness mode for promotional operation, e.g., to indicate a bonus condition.

To implement this method, an embodiment of a gaming device according to the present invention includes a fluorescent lamp fixture having a high frequency electronic ballast. Commercially available electronic ballasts typically dim a fluorescent lamp by varying the duty cycle of the high frequency AC power signal supplied to the lamp. Illumination level control circuitry is typically integrated into the ballast, and a control port, which provides external control of the brightness, is coupled to the bonusing hardware in the gaming device to control the lamp commensurate with promotional operation. An advantage of this embodiment is that it makes use of the existing fluorescent lamp fixture. Another advantage is that it can also be used to implement the method of flashing a fluorescent lamp as discussed above because electronic ballasts typically provide more rapid starting than conventional magnetic ballasts. Although an electronic ballast is more expensive than a conventional magnetic ballast, retrofitting a fluorescent illumination lamp in an existing gaming device with an electronic ballast is less expensive than adding an additional dedicated lamp for signaling promotional operation.

Color Signaling

Another aspect of the present invention achieves signaling operation for a gaming device by combining flashing and/or dimming operation of existing fluorescent illumination lamps with lamps of different colors. One such method according to the present invention is to operate a first fluorescent illumination lamp, which emits light of a first color, during normal operation, then operate a second lamp, which emits light of a second color, during promotional operation. By using different colored lamps and providing separate on-off control of each lamp, color signaling is achieved. An advantage of this method is that it uses the existing lamp fixture. A further advantage is that the multi-color fixtures add visual interest to the game and to the casino in which it is installed.

This method requires a gaming device having a multi-lamp fluorescent illumination fixture such as fixture 12 on the gaming device of FIG. 1. Different colored lamps can be installed when the machine is first manufactured, or they can be retrofitted into an existing machine. Any suitable technique for providing individual on-off control for each lamp can be used.

Another method according to the present invention is to operate fluorescent illumination lamps of different colors at different dimming levels and mixing the light from the different colored lamps, thereby providing a range of possible backlight hues which can be changed under program operation. This method also requires a gaming device having a multi-lamp fluorescent illumination fixture. Any suitable technique for providing dimming and mixing control of the light from the lamps can be used.

More advanced color signalling can be achieved by installing extra lamps in the gaming device cabinet. Using three additive lamps (red, green, blue) and dimming control, the backlight color can be made to vary across the entire visible light spectrum. Different colored lamps tend to have different intensities, so balancing the color requires control of all three lamps. In general, green and yellow lamps have the highest intensity, while red has the lowest. Blue lamps exhibit poor color saturation, and may require supplementary filters. Combinations of colors other than red, green, and blue could be used where full-spectrum coverage is not needed.

Instead of specific colored lamps, a filter can be used over a broad-spectrum lamp to control the color. For example, TM ROSCOLUX filter media can be used over F15T8 and F20T12 lamps. This filter media is rated for continuous high-temperature service in theatrical lighting, and exhibits good longterm color stability and well-defined pass- and stop-bands for the color spectrum. The filter media may increase the lamp temperature somewhat, so the safe operation range must be checked in a final installation. Using filters has a cost advantage because broad spectrum lamps are sold in high volume for aquarium use and house plant lighting.

A multi-color lamp fixture installed in accordance with the present invention preferably includes a diffuse light source and a sufficient space between the lamps and the glass to eliminate bright or dim spots and provide better color mixing. A distance of about 10 inches is typically required depending on the artwork printed on the glass. A diffuser panel is preferably placed a few inches behind the glass panel for clear panels. Since red lamps generally have the lowest intensity, a red lamp should preferably be placed closer to the glass than green or blue lights.

Figure 2:
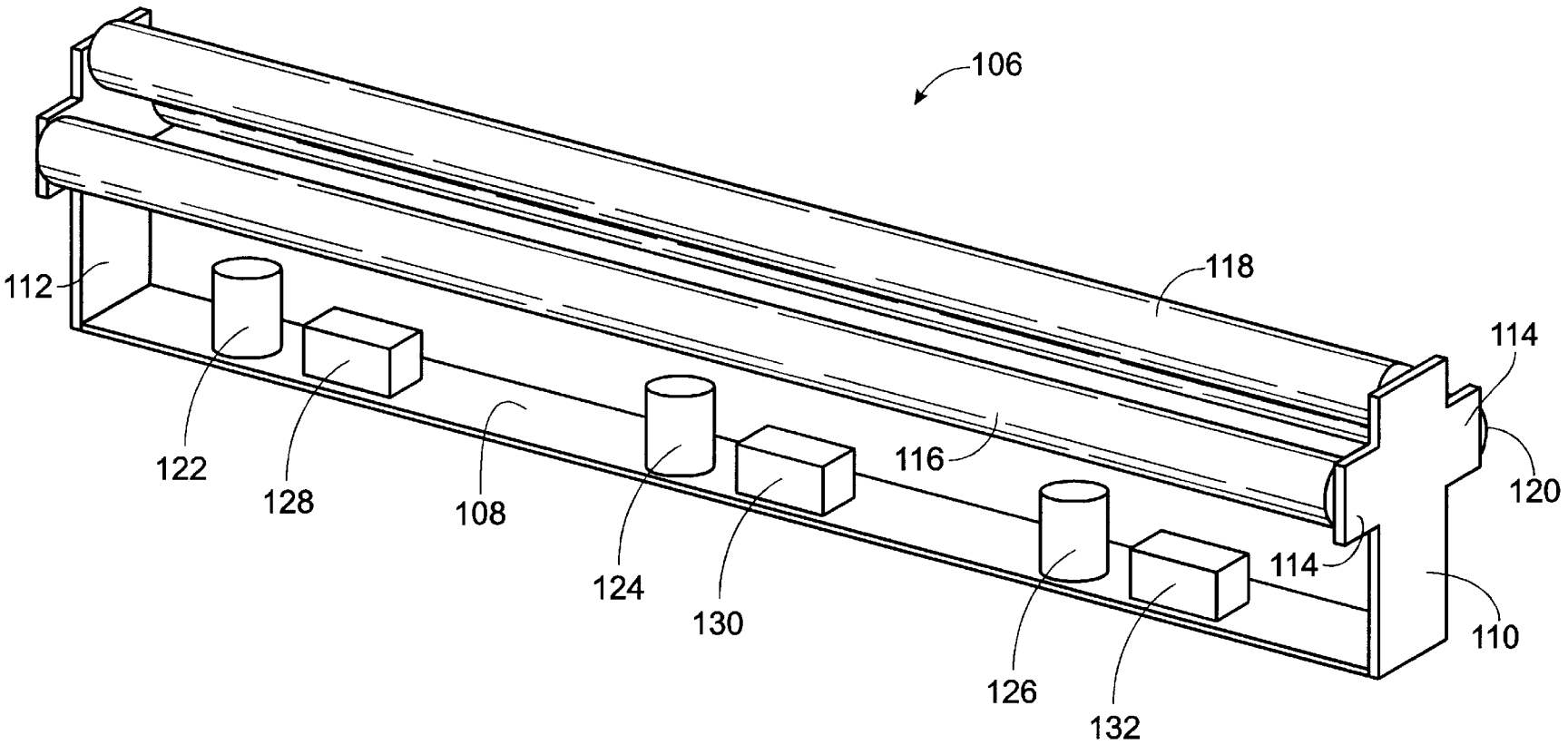
FIG. 2 is a perspective view of an embodiment of a multi-lamp fluorescent lamp fixture in accordance with the present invention.

A multi-lamp fluorescent lamp fixture in accordance with the present invention is shown generally at 106 in FIG. 2. The fixture includes a flat elongate base 108 and two upright supports 110 and 112 which are located at opposite ends of the base. Each support includes a pair of tabs 114 protruding sideways from the support near the top of the support. Three fluorescent lamps 116, 118, 120 fit between the uprights and are supported at either end in conventional sockets (not shown) with bi-pin contacts. The fixture 106 includes three starters 122, 124, and 126 mounted in sockets on the base, and three ballasts 128, 130, and 132 mounted on the base. One starter socket and ballast is wired to each lamp. The base is designed with the same footprint and mounting hole layout as existing single lamp fixtures. This reduces the time and expense associated with retrofitting the fixture into an existing gaming device. This three-lamp fixture can be mounted in place of a single lamp fixture in many existing gaming devices without having to modify the device. Another advantage of the fixture 106 is that it allows one bulb to be mounted closer to a glass panel than the other two bulbs, thus providing for easier balancing of lamps that emit light of different intensities.

Color signaling can be integrated into promotions in various ways. A method according to the present invention includes operating all the devices in a group of networked gaming devices with one color for normal operation. During a promotion, one device is selected to be a "lucky machine ", and the illumination lamps on that device are changed to a different color than the rest of the group to provide a "lucky machine" indicator. The "lucky machine" color indicator is moved randomly between different devices in the group. A player who wins a jackpot while the player's device is selected as the "lucky machine" wins a higher value prize than during normal operation. Such a method can also be used with monochrome signaling as described above. Many other combinations of flashing and dimming operation can be implemented by utilizing existing fluorescent illumination lamps according to the present invention.

Before describing the structure and operation of additional aspects of the present invention, consideration will first be given to the operational principles of fluorescent lamps.

Fluorescent Lamp Principles

Figure 3:
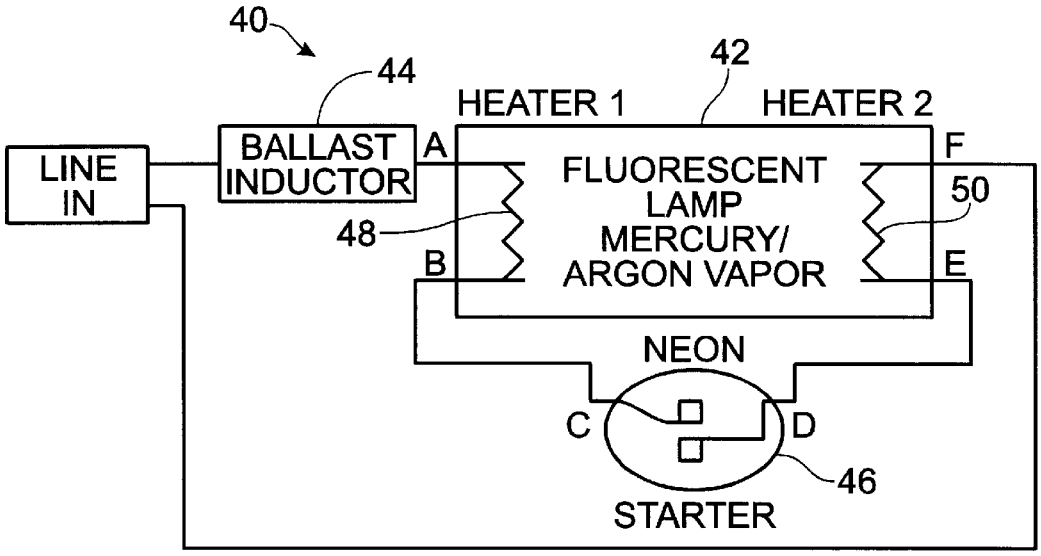
Fig. 3 (PRIOR ART)
FIG. 3 is a schematic diagram of a prior art control circuit for a fluorescent lamp.

A conventional fluorescent lamp control circuit is indicated generally at 40 in FIG. 3. The circuit 40 is typically housed in a fluorescent lamp fixture which includes a grounded metal frame (not shown) with bi-pin contacts at each end (not shown) to support a fluorescent lamp 42. A ballast 44 containing an iron core inductor packaged in a metal case is mounted in the fixture, along with a starter socket (not shown) and a starter 46, typically a bimetallic strip/neon glow tube type.

The hot conductor of an AC power line carrying line voltage is wired to one terminal of the ballast 44, while the other ballast terminal is connected to one terminal A of a first heating filament 48. The other terminal B of heating filament 48 is connected to one terminal C of the starter 46. The other starter terminal is connected to a first terminal E of a second heating filament 50. The second terminal F of the second heating filament is connected to the neutral conductor of the power line.

When the lamp is off and line voltage is first applied to the circuit, the line voltage is not high enough to cause an arc to form inside the lamp. Thus, the entire line voltage is applied across the starter. This causes the neon gas inside the starter to glow, and the resulting heat causes a bimetallic strip to bend, thereby closing the contacts inside the starter.

When the contacts close, the neon glow is extinguished. Current flows through the heater elements, and they glow orange-hot. The current is limited by the inductance of the ballast. Meanwhile, the bimetallic strip is cooling down.

When the bi-metallic strip cools enough, the contacts open. At the moment the contacts open, the current is interrupted and the ballast's magnetic field causes a large inductive voltage spike. This spike is high enough to ionize the gas inside the tube, aided by thermal electrons emitted from the heaters. A plasma arc forms between the heater elements, and ultra violet emissions from the arc excite the phosphor coating on the inside of the tube, thereby causing the tube to glow. The hot plasma persists long enough that the arc will restart easily on each half-cycle as the line voltage passes through zero.

The strike voltage of the plasma arc is lower then the strike voltage of the neon inside the starter bulb, so the starter does not reengage after the lamp is lit. If the lamp fails to start, the neon relights and the starting cycle repeats.

Flashing a Fluorescent Lamp

One technique for flashing a conventional fluorescent lamp is to intermittently interrupt the power to the entire lamp. This technique severely limits the frequency and duty cycle at which the lamp can be flashed because the heating elements must be preheated each time the lamp is restarted. If the heating elements are not preheated, the lamp life is severely reduced and starting becomes unreliable.

Attempts have been made to replace contact type starters with sold state units to achieve rapid ignition. One such unit is disclosed by M. Gyoten, K. Ito, and N. Yoshikawa in "Development of an Electronic Starter for Fluorescent Lamps" published in *Journal of the Illuminating Engineering Society*, Summer 1995, and presented at the 1994 IESNA Annual Conference. Gyoten, et al. disclose an electronic starter that is enclosed within a conventional starter housing which can be inserted into a standard starter socket. However, this starter still requires a substantial amount of time to strike an arc. Further, although this electronic starter can initiate an arc in a fluorescent lamp when power is initially applied to the system, it does not provide any means for controlling the lamp after power is applied.

Another problem with flashing a fluorescent lamp by interrupting power to the lamp is that it requires an external device for switching the power on and off. This is especially problematic when adapting an existing fluorescent lamp fixture for flashing operation since the fixture requires expensive and time-consuming rewiring.

Dimming a Fluorescent lamp

Since fluorescent lamps require a minimum voltage level for operation, dimming generally cannot be accomplished by reducing the operating voltage. Dimming a fluorescent lamp is generally accomplished by flashing the lamp at a fast enough rate that the human eye cannot perceive the flash. A high frequency electronic ballast is used to generate flashes that provide continuous range dimming by varying the duty cycle of the plasma arc. Unfortunately, high frequency electronic ballasts are expensive, and retrofitting existing fluorescent light fixtures with electronic ballasts is also expensive and time consuming.

Controllable Starter Circuit

Figure 4:
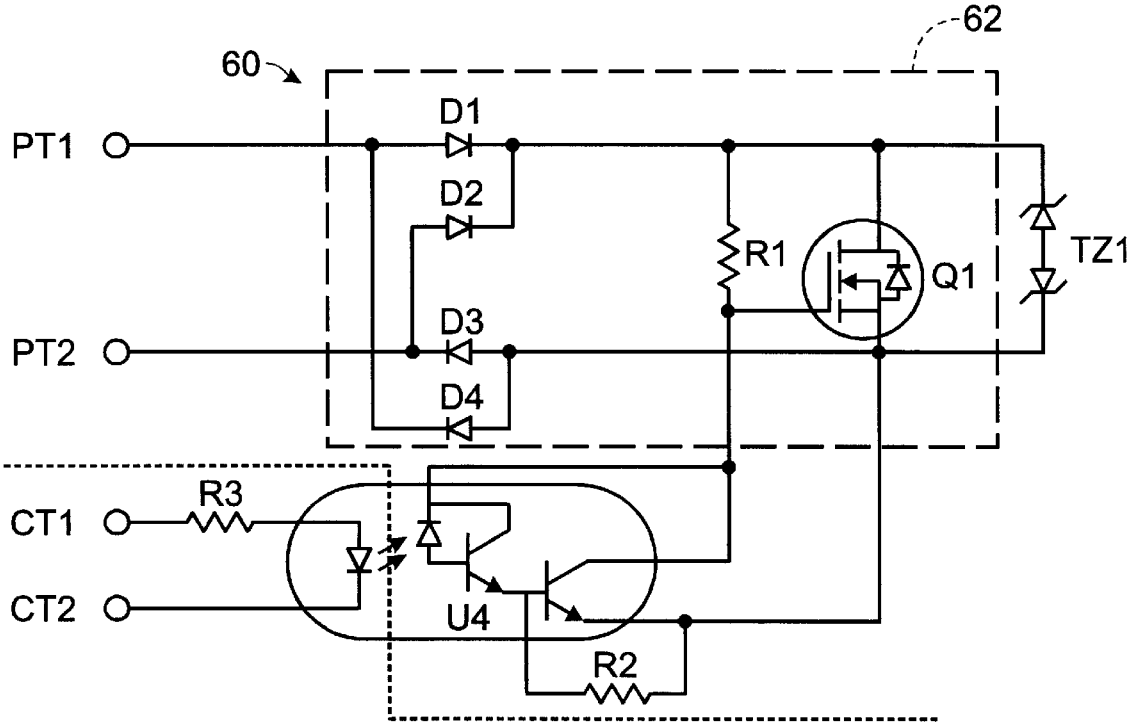
FIG. 4 is a schematic diagram of an embodiment of a control circuit for a fluorescent lamp in accordance with the present invention.

Indicated generally at 60 in FIG. 4 is an embodiment of a controllable starter circuit in accordance with the present invention. Circuit 60 replaces the neon starter 46 of FIG. 3 and includes first and second AC power terminals PT1 and PT2 for connecting the starter circuit 60 to nodes C and D in the conventional fluorescent light circuit of FIG. 3. The circuit also includes a control port formed by a first control terminal CT1 and a second control terminal CT2. The circuit further includes a switch 62 which provides a controlled current path between the power terminals PT1 and PT2 and is controlled by a switch control terminal.

In a preferred embodiment, the switch 62 has a full-wave rectifier bridge including diodes D1, D2, D3 and D4. Diodes D1 and D2 have their cathodes connected together at a positive node N1 which forms a first output terminal of the bridge, while diodes D3 and D4 have their anodes connected together at a negative node N2 which forms a second output terminal of the bridge. The anode of D1 is connected to the cathode of D4 at terminal P1, and the anode of D2 is connected to the cathode of D3 at terminal P2. In a preferred embodiment, the switch 62 also includes a power MOSFET Q1 which has a drain connected to node N1, and a source terminal is connected to node N2. The gate of Q1 forms the switch control terminal. A resistor R1 is connected between the gate and drain of Q1. A transient voltage suppressor TZ1 is connected between nodes N1 and N2.

An optocoupler U4 has an output stage that is connected to provide a controlled current path between the gate and source of Q1. Optocoupler U4 also has an input LED with an anode connected to the first control terminal CT1 through a resistor R3 and a cathode connected to the second control terminal CT2.

In operation, the full wave bridge rectifies the AC current flowing into terminals PT1 and PT2 so that transistor Q1 can control current flowing in both directions. This eliminates the need for back-to-back switching transistors. Transient suppressor TZ1, which comprises of a zener diode, clamps the voltage across transistor Q1 to prevent damage to Q1. Pull-up resistor R1 keeps Q1 turned on in the absence of a control signal so that the lamp defaults to off. When a 20 milliamp (mA) current-limited control signal is fed into the LED of optocoupler U4 through control terminals CT1 and CT2, the output stage turns on, thereby short circuiting the gate and source of Q1 and turning Q1 off.

The starter circuit of FIG. 4 provides a simple and inexpensive technique for flashing or dimming a fluorescent lamp, and it can be fabricated with commonly available components. For example, Q1 can be an IRF840 with a voltage rating of 650 volts, and TZ1 can be made from a 400 volt zener diode so as to prevent damage to Q1. Alternatively, TZ1 can be a TM TRANSORB voltage suppressor such as type P4KE400Ca from General Instrument. D1 through D4 are preferably FR017 devices. R1 is sized so that 240 VAC does not cause it to dissipate more than its rated power while still having a low enough resistance to provide fast turn-on to the gate of Q1, for example, 100K at ½ watt. U4 can be a CNW139 photo-Darlington IC or any other device that provides enough creepage clearance to meat safety requirements (e.g., AS3260 requires 6 mm creepage distance).

A fluorescent lamp circuit that includes a controllable starter as shown in FIG. 4 is preferably started according to the following sequence:

(1) During a preheat time period of approximately 1.5 seconds, AC power is applied to the circuit and no drive current is supplied to U4. The transistor Q1 is held on by R1 and current flows through the heater filaments to provide pre-heating.

(2) During a striking time period of approximately 50 milliseconds (ms), the optocoupler U4 is driven with a 20 mA control signal at a 50% duty cycle at 1 KHz, thereby repetitively striking an arc. This assures that the arc is struck during at least one line cycle (typically 16.67 ms) to avoid problems with zero crossings.

(3) The control signal is then driven on continuously to hold transistor Q1 off, thereby allowing the lamp to remain on continuously.

Once the lamp is started, it can then be operated in a flashing mode by turning Q1 on, thereby shorting the lamp during an off-time, then repeating steps (2) and (3) above. The pre-heat step can be eliminated, since pre-heat current flows through the heater filaments during the lamp off-time. It is preferable to repeat the arc striking step (2) each time the lamp is restarted to improve reliability. The flash rate should be kept below 5 Hz for aesthetic purposes, preferably 1–2 Hz, with a minimum on-time of 100 ms, and a longer delay for the off-time.

Alternatively, once the lamp is started, it can then be dimmed, or dimmed in combination with flashing operation. Dimming is accomplished by switching the starter on and off at a high frequency. The output can be varied from full intensity to a faint glow by varying the duty cycle of the control signal. The control signal is preferably pulse width modulated between 5% and 50% lamp on-time. Values greater than 50% add little or no perceptible increase in light output, while values below 5% make the arc unstable and cause flickering. Restarting is not a problem with dimming operation because the heaters are kept warm by the starter at low duty cycles, and the arc retains enough energy for easy restarting at high duty cycles.

When dimming smaller fluorescent lamps, it might be necessary to baffle the ends of the lamp to block light emitted proximate the heater filaments. This is because, on smaller lamps, hot cathode electrons tend to keep glowing even when there is no arc, thereby causing the lamp to glow with a brighter intensity than intended.

Although 10 KHz is a preferable operational frequency, there is wide latitude in the operational frequency for dimming operation. Frequencies that are too low, however, cause audio noise (whines and beeps) while frequencies that are too high (over 200 KHz) cause the lamp to stop glowing since the rise time of the lamp current is longer than the pulse width. Frequencies which are multiples of the line frequency should also be avoided as this can result in a beat frequency which could interfere with operation.

Any suitable controller can be used to generate the control signal. For flashing operation, a simple 555 timer circuit can be used. A microcontroller such as a PIC16C54 can be used to implement flashing and dimming operation for a single or multiple lamp system.

Starter Package

Figure 5:
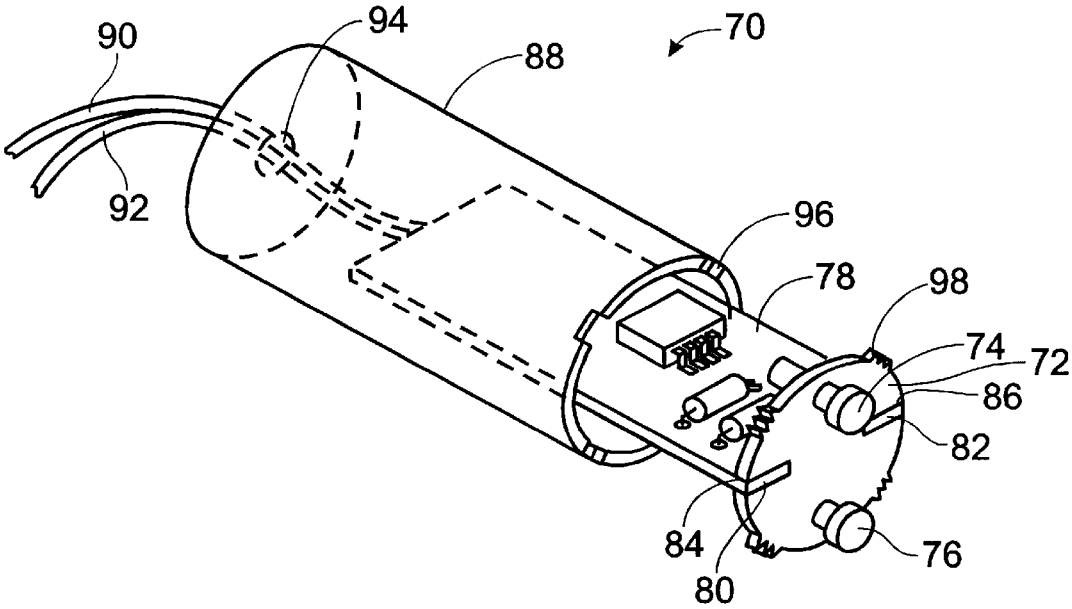
FIG. 5 is an exploded view of a controllable starter assembly for a fluorescent lamp in accordance with the present invention.

The starter circuit 60 is packaged in a can-shaped starter body that allows installation in the place of existing starters without changing any other components in the lamp fixture. Referring to FIG. 5, a starter assembly in accordance with the present invention is shown generally at 70 and includes a starter body having a disk-shaped printed circuit board base 72 that fits into a standard fluorescent starter socket. Two tin-plated brass contact feet 74 and 76 are fit into holes in the bottom member and spaced so as to engage the contacts in a standard starter socket. The contact feet are soldered to traces (not shown) on the top side of base 72. The circuit 60 is fabricated on a printed circuit board 78 which has two tabs 80 and 82 for engaging slots 84 and 86 on the base 72. Traces (not shown) on circuit board 78 are soldered to the traces on base 72 to provide electrical contact between the contact feet 74 and 76 and the power terminals PT1 and PT2 of circuit 60.

The starter body also includes a cylindrical plastic housing 88 which slides over the printed circuit board to enclose the board. Notches 96 in the housing engage protrusions 98 in the base to lock the housing in place. The use of a plastic housing prevents electric shock hazard to a technician working on the machine. The housing should be long enough to facilitate gripping the housing when the body is inserted into a socket, but not too long so as to interfere with other components.

A pair of wire leads 90 and 92 for coupling the starter circuit 60 to a controller pass through an orifice 94 at the end of the housing and are connected to the control port terminals CT1 and CT2. Alternatively, a controller such as a 555 timer or a microcontroller can be integrated onto the circuit board 78, and the wire leads can be used to transmit high-level commands to the controller which generates the control signal to drive the starter circuit.

A metal housing can be used for the starter body in applications where power dissipation may cause excessive heating. Additionally, the starter assembly can be filled with a potting material such as thermally conductive epoxy resin to facilitate heat transfer from circuit components to the housing. Potting material has additional advantages because it helps prevent tampering and provides additional protection from shock hazard.

Figure 6:
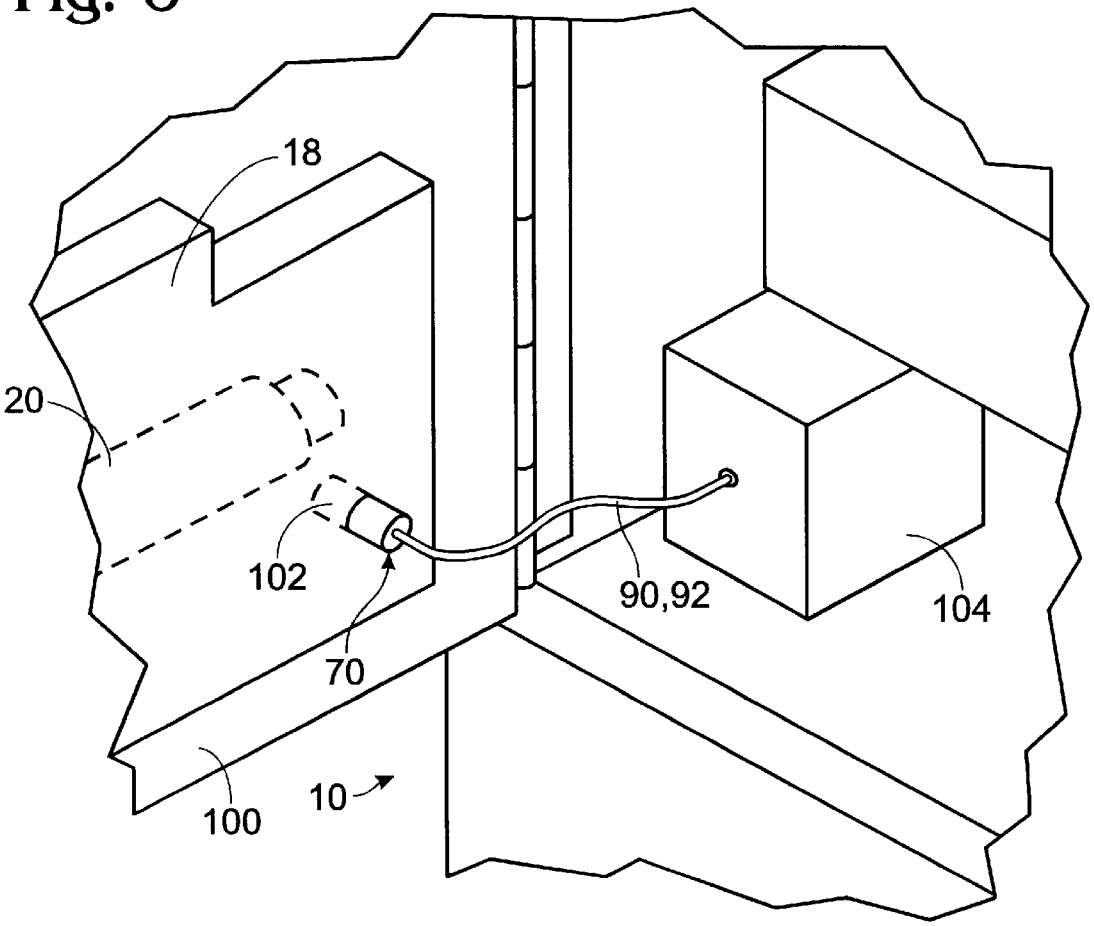
FIG. 6 is a perspective view showing the starter assembly of FIG. 5 installed on a fluorescent light fixture on a gaming device.

A method for modifying an existing gaming device according to the present invention will now be described with reference to FIGS. 1 and 6. A gaming device 10 in FIG. 1 includes fluorescent lamp fixture 18 mounted on a hinged door 100. The door is shown in an open position in FIG. 6 where a technician can gain access to the conventional starter in starter socket 102 which controls lamp 20. The conventional starter is removed from the socket 102, and a controllable starter assembly 70 is inserted in its place. The wire leads 90 and 92 are connected to a controller 104 which can be a dedicated controller for the fluorescent lamp, or a bonusing controller having integrated lamp control functions. This method minimizes the cost of providing signaling on a gaming device because it utilizes the existing lamp fixture and circuitry and because it requires little effort to replace the starter assembly. This method can also be used to modify a multi-lamp fixture such as that shown in FIG. 2. Three controllable starters are mounted in the fixture, and the control leads from each starter are connected to a controller to provide flashing, dimming, and color mixing operation of the various lamps in the fixture.

Having described and illustrated the principles of the invention in a preferred embodiment thereof, it should be apparent that the invention can be modified in arrangement and detail without departing from such principles. I claim all modifications and variations coming within the spirit and scope of the following claims.

I claim:

1. A controllable starter circuit for a fluorescent lamp comprising:

a first power terminal for coupling the starter circuit to a fluorescent lamp circuit;

a second power terminal for coupling the starter circuit to a fluorescent lamp circuit;

a control port for receiving an external control signal;

a switch having:

a controlled current path coupled between the first and second power terminals;

a switch control terminal coupled to the control port to receive the control signal;

a rectifier bridge having a first input terminal coupled to the first power terminal, a second input terminal coupled to the second power terminal, a first output terminal, and a second output terminal; and a transistor having a controlled current path coupled between the first and second output terminals of the rectifier bridge;

a voltage suppressor coupled in parallel with the switch; and a resistor coupled between the switch control terminal and the first output terminal of the rectifier bridge so as to hold the switch in a conductive state in the absence of a control signal.

2. A controllable starter circuit for a fluorescent lamp comprising:

a first power terminal for coupling the starter circuit to a fluorescent lamp circuit;

a second power terminal for coupling the starter circuit to a fluorescent lamp circuit;

a control port for receiving an external control signal; and a switch having:

a controlled current path coupled between the first and second power terminals;

a switch control terminal coupled to the control port to receive the control signal;

a rectifier bridge having a first input terminal coupled to the first power terminal, a second input terminal coupled to the second power terminal, a first output terminal, and a second output terminal;

a transistor having a drain coupled to the first output terminal of the rectifier bridge, a source coupled to the second output terminal of the rectifier bridge, and a gate;

a voltage suppressor coupled between the first and second output terminals of the rectifier bridge; and a resistor coupled between the drain and gate of the transistor.

3. A starter circuit according to claim 2 wherein the control port includes a first control terminal and a second control terminal, and further including an optical isolator having:

an input section having a first input terminal coupled to the first control terminal and a second input terminal coupled to the second control terminal; and an output section having a first output terminal coupled to the gate of the transistor and a second output terminal coupled to the source of the transistor.

4. A method for starting a fluorescent lamp having a starter switch coupled in parallel with the lamp, the method comprising:

closing the starter switch during a preheat period, thereby preheating a filament in the lamp;

repetitively opening and closing the starter switch during a striking period, thereby striking an arc; and opening the switch after the end of the striking period, thereby maintaining the arc.

5. A method according to claim 4 wherein the preheat period is approximately 1.5 seconds.

6. A method according to claim 4 wherein the striking period is at least as long as about one cycle of an AC power source that powers the circuit.

7. A method according to claim 4 wherein the striking period is about 50 milliseconds.

8. A method according to claim 4 wherein repetitively opening and closing the starter switch includes repetitively opening and closing the starter switch at a fixed duty cycle.

9. A method according to claim 8 wherein the duty cycle is about 50 percent.

10. A method according to claim 4 wherein repetitively opening and closing the starter switch includes repetitively opening and closing the starter switch at a fixed frequency.

11. A method according to claim 10 wherein the frequency is about 1 KHz.

12. A method for flashing a fluorescent lamp having a starter switch coupled in parallel with the lamp, the method comprising:

opening the starter switch during an on period, thereby striking an arc; and closing the starter switch during an off period, thereby extinguishing the arc and heating a filament in the lamp.

13. A method according to claim 12 further including closing the starter switch during a preheat period, thereby preheating the filament.

14. A method according to claim 12 further including repetitively opening and closing the starter switch during a striking period at the beginning of the on period, thereby striking an arc.

15. A method according to claim 12 wherein the on period is at least 100 milliseconds long.

16. A method according to claim 12 wherein the starter switch is opened and closed at a frequency of less than about 5 Hz.

17. A method according to claim 12 wherein the starter switch is opened and closed at a frequency of between about 1 and 2 Hz.

18. A method for dimming a fluorescent lamp having a starter switch coupled in parallel with the lamp, the method comprising:

opening the starter switch during an on period, thereby striking an arc;

closing the starter switch during an off period, thereby extinguishing the arc and heating a filament in the lamp; and rapidly repeating opening and closing the starter switch at a high enough frequency that the arc appears to be operating continuously.

19. A method according to claim 18 further including controlling the duty cycle of the switch, thereby controlling the light output of the lamp.

20. A method according to claim 19 wherein the duty cycle of the switch is between about 5 and 50 percent.

21. A method according to claim 18 wherein the starter switch is opened and closed a frequency of between about 10 KHz and 200 KHz.

22. A method according to claim 18 further including blocking light emitted from the portion of the lamp proximate the filament.

23. A method for generating variable colored light with two or more fluorescent lamps, each lamp emitting a different colored light, the method comprising:

repetitively opening and closing a first starter switch coupled in parallel with a first fluorescent lamp, thereby generating a first colored light;

controlling the duty cycle of the first switch, thereby controlling the light output of the first lamp;

repetitively opening and closing a second starter switch coupled in parallel with a second fluorescent lamp, thereby generating a second colored light;

controlling the duty cycle of the second switch, thereby controlling the light output of the second lamp; and mixing the light generated by the first and second lamps.

24. A method according to claim 23 further including:

repetitively opening and closing a third starter switch coupled in parallel with a third fluorescent lamp, thereby generating a third colored light;

controlling the duty cycle of the third switch, thereby controlling the light output of the third lamp; and mixing the light generated by the third lamp with the light generated by the first and second lamps.

25. A method according to claim 23 further including balancing the light output of the first and second lamps, thereby adjusting the color of the mixed light.

26. A method according to claim 23 further including diffusing the light emitted from the first and second lamps.

27. A system for generating variable colored light comprising:

a first fluorescent lamp assembly that generates a first colored light including:

a first fluorescent lamp; and a first controllable starter switch coupled in parallel with the first lamp and having a control port for receiving a first control signal;

a second fluorescent lamp assembly that generates a second colored light including:

a second fluorescent lamp; and a second controllable starter switch coupled in parallel with the second lamp and having a control port for receiving a second control signal;

a controller coupled to the first and second control ports, the controller generating the first control signal for controlling the first starter switch and the second control signal for controlling the second starter switch.

28. A system according to claim 27 wherein the controller generates a third control signal, and further including a third fluorescent lamp assembly that generates a third colored light including:

a third fluorescent lamp; and a third controllable starter switch coupled in parallel with the third lamp, the third controllable starter switch having a control port coupled to the controller for receiving the third control signal.

29. A system according to claim 28 wherein the first color is red, the second color is green, and the third color is blue.

30. A system according to claim 27 wherein the first fluorescent lamp emits broad spectrum light, and the first fluorescent lamp assembly further includes a filter that passes a first colored light from the first fluorescent lamp.

31. A system according to claim 27 wherein the first fluorescent lamp emits a first colored light.

32. A system according to claim 27 wherein the system is mounted in a fluorescent lamp fixture.

33. A system according to claim 27 wherein the system is mounted in a gaming device.

34. A method for signaling promotional operation of a gaming device having a fluorescent illumination lamp, the method comprising:

operating the lamp in a first mode during normal operation; and operating the lamp in a second mode during promotional operation.

35. A method according to claim 34 wherein:

operating the lamp in a first mode includes operating the lamp at a first illumination level; and operating the lamp in a second mode includes operating the lamp at a second illumination level.

36. A method according to claim 35 wherein the first illumination level is about half brightness and the second illumination level is about full brightness.

37. A method according to claim 34 wherein:

operating the lamp in a first mode includes operating the lamp continuously; and operating the lamp in a second mode includes flashing the lamp.

38. A method for signaling promotional operation of a gaming device having a first fluorescent illumination lamp that emits light of a first color and a second fluorescent illumination lamp that emits light of a second color, the method comprising:

operating the first lamp at a first illumination level and the second lamp at a second illumination level during normal operation;

operating the first lamp at a third illumination level and the second lamp at a fourth illumination level during promotional operation; and mixing the light from the first and second lamps.

39. A method according to claim 38 wherein the gaming device further includes a third fluorescent illumination lamp that emits light of a third color, and further including:

operating the third lamp at a fifth illumination level during normal operation;

operating the third lamp at a sixth illumination level during promotional operation; and mixing the light from the third lamp with the light from the first and second lamps.

40. A gaming device comprising:

a fluorescent illumination lamp;

a fluorescent lamp circuit coupled to the lamp to provide power to the lamp, the lamp circuit including a magnetic ballast coupled to the lamp;

lamp control means coupled to the lamp circuit to control the operation of the lamp responsive to a control signal, the lamp control means including a controllable starter coupled to the lamp and the lamp circuit to control the lamp responsive to the control signal; and a controller that generates the control signal;

a second fluorescent illumination lamp;

a second fluorescent lamp circuit coupled to the second lamp to provide power to the second lamp; and second lamp control means coupled to the second lamp circuit to control the operation of the second lamp responsive to a second control signal from the controller.

41. A gaming device according to claim 40 wherein the first lamp generates light of a first color and the second lamp generates light of a second color.

* * * * *